US011776488B2

(12) United States Patent
Li et al.

(10) Patent No.: US 11,776,488 B2
(45) Date of Patent: Oct. 3, 2023

(54) LIGHT-EMITTING SUBSTRATE AND DISPLAY DEVICE

(71) Applicant: TCL CHINA STAR OPTOELECTRONICS TECHNOLOGY CO., LTD., Guangdong (CN)

(72) Inventors: Yan Li, Guangdong (CN); Yihe Zhang, Guangdong (CN); Lixia Li, Guangdong (CN); Haiyan Quan, Guangdong (CN); Duyeon Han, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 324 days.

(21) Appl. No.: 17/251,980

(22) PCT Filed: Nov. 26, 2020

(86) PCT No.: PCT/CN2020/131721
§ 371 (c)(1),
(2) Date: Dec. 14, 2020

(87) PCT Pub. No.: WO2022/095157
PCT Pub. Date: May 12, 2022

(65) Prior Publication Data

US 2022/0319449 A1 Oct. 6, 2022

(30) Foreign Application Priority Data

Nov. 9, 2020 (CN) ..... 202011238126.4

(51) Int. Cl.
*G09G 3/34* (2006.01)
*G09G 3/32* (2016.01)

(52) U.S. Cl.
CPC ..... *G09G 3/3406* (2013.01); *G09G 3/32* (2013.01); *G09G 3/342* (2013.01); *G09G 3/3413* (2013.01); *G09G 2320/0233* (2013.01)

(58) Field of Classification Search
CPC ..... G09G 3/3406; G09G 3/32; G09G 2320/0233; G09G 2310/024; G09G 3/342; G09G 2320/0204; G09G 3/3413
See application file for complete search history.

(56) References Cited

U.S. PATENT DOCUMENTS 9,299,319 B2 * 3/2016 Han ..... G09G 5/10
10,388,214 B2 * 8/2019 Na ..... G09G 3/3233
(Continued)

FOREIGN PATENT DOCUMENTS

CN 106205540 12/2016
CN 106782363 5/2017
(Continued)

*Primary Examiner* — Vijay Shankar

(57) ABSTRACT

A light-emitting substrate and a display device are provided by the present application. The durations of pre-set periods of a plurality of driving circuits decrease along a direction from close to data signal input terminals to away from the data signal input terminals, and/or durations of the pre-set periods of the plurality of driving circuits decrease along a direction from close to first control signal input terminals to away from the first control signal input terminals, which the light-emitting luminance of the light-emitting elements at a near-end and far-end solving a display problem with the display device.

20 Claims, 5 Drawing Sheets

(56) References Cited

U.S. PATENT DOCUMENTS

| | | | | |
|---|---|---|---|---|
| 10,872,573 | B2 * | 12/2020 | Li | G09G 3/3266 |
| 2012/0293482 | A1 | 11/2012 | Wu et al. | |
| 2014/0139566 | A1 * | 5/2014 | Han | G09G 3/2022 345/82 |
| 2016/0155379 | A1 * | 6/2016 | Na | G09G 3/3233 345/215 |
| 2018/0224700 | A1 | 8/2018 | Yue et al. | |
| 2020/0234622 | A1 | 7/2020 | Xiong | |
| 2020/0265786 | A1 * | 8/2020 | Li | G09G 3/3266 |

FOREIGN PATENT DOCUMENTS

| | | | | |
|---|---|---|---|---|
| CN | 107086025 | | 8/2017 | |
| CN | 108538241 | | 9/2018 | |
| CN | 109509446 | | 3/2019 | |
| CN | 109584808 | | 4/2019 | |
| CN | 109686290 | | 4/2019 | |
| CN | 109920363 | | 6/2019 | |
| CN | 110047436 | | 7/2019 | |
| CN | 111798804 | | 7/2019 | |
| EP | 3648091 | A1 * | 5/2020 | G09G 3/3233 |
| KR | 2019-0029053 | | 3/2019 | |

* cited by examiner

LIGHT-EMITTING SUBSTRATE AND DISPLAY DEVICE

RELATED APPLICATIONS

This application is a National Phase of PCT Patent Application No. PCT/CN2020/131721 having International filing date of Nov. 26, 2020, which claims the benefit of priority of Chinese Patent Application No. 202011238126.4 filed on Nov. 9, 2020. The contents of the above applications are all incorporated by reference as if fully set forth herein in their entirety.

FIELD AND BACKGROUND OF THE INVENTION

Field of Invention

The present application relates to the field of display technology and particularly to a light-emitting substrate and a display device.

At present, in active submillimeter light-emitting diode (Mini-LED) backlight modules, scan lines are usually needed to input scanning signals and data lines are usually needed to input data signals. However, thicknesses of the scanning lines and the data lines are usually a few microns, which makes impedances of scan lines and data lines greater, resulting in differences between waveforms of scanning signals near scanning signal input terminals and waveforms of scanning signals away from scanning signal input terminals, as well as differences between waveforms of data signals near data signal input terminals and waveforms of data signals away from data signal input terminals. Differences between waveforms of signals (data signals and scanning signals) of near-ends and far-ends of signal input terminals (data signal input terminals and scanning signal input terminals) will induce an obvious luminance difference between submillimeter light-emitting diodes of near-ends and far-ends of the signal input terminals. Especially, the larger a backlight module is, the greater the luminance differences will be, which affects the display effect of display devices.

Therefore, it is necessary to propose a technical solution to display problems caused by luminance differences between the near-ends and the far-ends of the backlight module.

SUMMARY OF THE INVENTION

The present application aims to provide a light-emitting substrate and a display device to solve display problems caused by the luminance differences between the near-end and the far-end of the backlight module.

To fulfil the above-mentioned purpose, a light-emitting substrate is provided, including:

a plurality of data lines, wherein each of the data lines includes a data signal input terminal;

a plurality of first control signal lines, wherein each of the first control signal lines includes a first control signal input terminal; and a plurality of driving circuits, wherein each of the driving circuits includes:

a light-emitting element;

a switching transistor, wherein a gate electrode of the switching transistor is connected to the first control signal line, and a first electrode of the switching transistor is connected to the data line;

a driving transistor, wherein a gate electrode of the driving transistor is connected to a second electrode of the switching transistor, and one of a first electrode or a second electrode of the driving transistor is connected to the light-emitting element; and a control unit, wherein the control unit is connected to one of the first electrode or the second electrode of the driving transistor, wherein when the switching transistor is in an on state, the control unit is in an off state during a pre-set period, and the switching transistor is in an on state during periods other than the pre-set period, wherein durations of the pre-set periods of the plurality of driving circuits decrease along a direction from close to the data signal input terminals to away from the data signal input terminals, and/or durations of the pre-set periods of the plurality of driving circuits decrease along a direction from close to the first control signal input terminals to away from the first control signal input terminals.

In the light-emitting substrate, the light-emitting substrate further includes a plurality of second control signal lines; and the control unit includes a control transistor, a gate electrode of the control transistor is connected to the second control signal line, and the control transistor is connected to the second electrode of the driving transistor.

In the light-emitting substrate, each of the first control signal lines is configured to transmit a first control signal, the switching transistor is in an on state according to an valid first control signal, and a falling edge of the valid first control signal is located in the pre-set period.

In the light-emitting substrate, the light-emitting element is connected to the first electrode of the driving transistor.

In the light-emitting substrate, the control unit is in an on state when the switching transistor is in an off state.

In the light-emitting substrate, the light-emitting substrate is a display panel or a backlight module.

In the light-emitting substrate, durations of the pre-set periods of the plurality of driving circuits decrease along a direction from close to the data signal input terminals to away from the data signal input terminals, and durations of the pre-set periods of the plurality of driving circuits decrease along a direction from close to the first control signal input terminals to away from the first control signal input terminals.

In the light-emitting substrate, the light-emitting element is at least one of submillimeter light-emitting diode, miniature light-emitting diode, or organic light-emitting diode.

In the light-emitting substrate, the light-emitting substrate further includes a data driving circuit and a gate electrode driving circuit, the data signal input terminals of the plurality of data lines are connected to the data driving circuit, and the first control signal input terminals of the plurality of first control signal lines are connected to the gate electrode driving circuit.

A display device comprising a light-emitting substrate, wherein the light-emitting substrate includes:

a plurality of data lines, wherein each of the data lines includes a data signal input terminal;

a plurality of first control signal lines, wherein each of the first control signal lines includes a first control signal input terminal; and a plurality of driving circuits, wherein each of the driving circuits includes:

a light-emitting element;

a switching transistor, wherein a gate electrode of the switching transistor is connected to the first control signal line, and a first electrode of the switching transistor is connected to the data line;

a driving transistor, wherein a gate electrode of the driving transistor is connected to a second electrode of the switching transistor, and one of a first electrode or a second electrode of the driving transistor is connected to the light-emitting element; and a control unit, wherein the control unit is connected to one of the first electrode or the second electrode of the driving transistor, wherein when the switching transistor is in an on state, the control unit is in an off state during a pre-set period, and the switching transistor is in an on state during periods other than the pre-set period, wherein durations of the pre-set periods of the plurality of driving circuits decrease along a direction from close to the data signal input terminals to away from the data signal input terminals, and/or durations of the pre-set periods of the plurality of driving circuits decrease along a direction from close to the first control signal input terminals to away from the first control signal input terminals.

In the display device, the light-emitting substrate further includes a plurality of second control signal lines, The control unit includes a control transistor, a gate electrode of the control transistor is connected to the second control signal line, and the control transistor is connected to the second electrode of the driving transistor.

In the display device, each of the first control signal lines is configured to transmit a first control signal, the switching transistor is in an on state according to an valid first control signal, and a falling edge of the valid first control signal is located in the pre-set period.

In the display device, the light-emitting element is connected to the first electrode of the driving transistor.

In the display device, the control unit is in an on state when the switching transistor is in an off state.

In the display device, the light-emitting substrate is a display panel or a backlight module.

In the display device, durations of the pre-set periods of the plurality of driving circuits decrease along a direction from close to the data signal input terminals to away from the data signal input terminals, and durations of the pre-set periods of the plurality of driving circuits decrease along a direction from close to the first control signal input terminals to away from the first control signal input terminals.

In the display device, the light-emitting element is at least one of submillimeter light-emitting diode, miniature light-emitting diode, or organic light-emitting diode.

In the display device, the light-emitting substrate further includes a data driving circuit and a gate electrode driving circuit, the data signal input terminals of the plurality of data lines are connected to the data driving circuit, and the first control signal input terminals of the plurality of first control signal lines are connected to the gate electrode driving circuit.

The light-emitting substrate and the display device are provided by the present application. The durations of the pre-set periods of the plurality of driving circuits decrease along a direction from close to the data signal input terminals to away from the data signal input terminals, and/or durations of the pre-set periods of the plurality of driving circuits decrease along a direction from close to the first control signal input terminals to away from the first control signal input terminals. So that the light-emitting durations of the light-emitting elements close to the data signal input terminals is shorter than the light-emitting durations of the light-emitting elements away from the data signal input terminals, and/or light-emitting durations of the light-emitting elements close to the first control signal input terminals is shorter than the light-emitting durations of the light-emitting elements away from the first control signal input terminals and is beneficial to the identity of the light-emitting luminance of the light-emitting elements of the near-end and the far-end to solve the display problems of the display device.

DESCRIPTION OF SPECIFIC EMBODIMENTS OF THE INVENTION

The present application is further described in detail below with reference to the accompanying drawings and embodiments. Obviously, the following described embodiments are only part of the present application but not all. A person having ordinary skill in the art may obtain other embodiments based on the embodiments provided in the present application without making any creative effort, which all belong to the scope of the present application.

Figure 1:
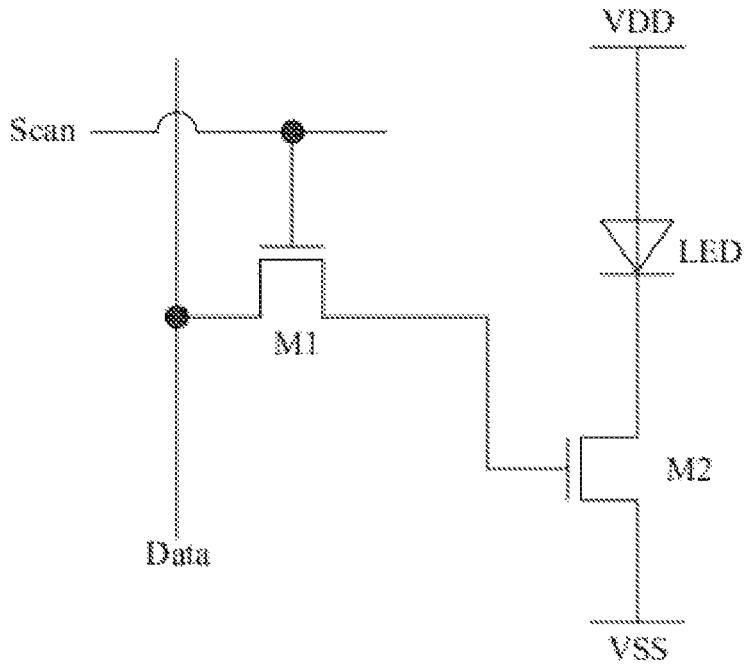
FIG. 1 is a schematic diagram of a driving circuit of conventional active backlight modules.
Figure 2:
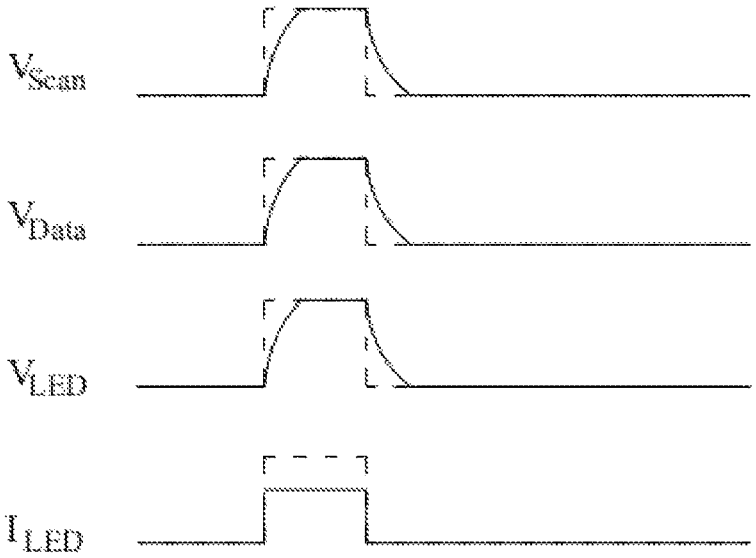
FIG. 2 is a sequence diagram of near-ends of a scanning signal input terminal and a data signal input terminal, and far-ends of a scanning signal input terminal and a data signal input terminal corresponding to the driving circuit illustrated in FIG. 1.

Please refer to FIG. 1 and FIG. 2. FIG. 1 is a schematic diagram of a driving circuit of conventional active backlight modules. FIG. 2 is a sequence diagram of near-ends of a scanning signal input terminal and a data signal input terminal, and far-ends of a scanning signal input terminal and a data signal input terminal corresponding to the driving circuit illustrated in FIG. 1. The driving circuit of the conventional active back-light module includes a driving transistor M2, a switching transistor M1 and a light-emitting diode LED. A gate electrode of the switching transistor M1 is connected to a scanning signal line Scan, a first electrode of the switching transistor M1 is connected to a data line Data, a second electrode of the switching transistor M1 is connected to a gate electrode of the driving transistor M2. The light-emitting diode LED is connected between a first electrode of the driving transistor M2 and a first power supply signal line VDD, and a second electrode of the driving transistor M2 is connected to a second power supply signal line VSS. Both the driving transistor M2 and the switching transistor M1 are N-type thin film transistors.

In a light-emitting stage, a high-level scanning signal $V_{Scan}$ is inputted by the scanning signal line Scan, and a high level data signal Data of is inputted by the data line Data. Pulse widths of the high-level scanning signal $V_{Scan}$ and the high-level data signal $V_{Data}$ of are identical. The switching transistor M1 and the driving transistor M2 are turned on, and the light-emitting diode LED emits light.

As shown in FIG. 2, as waveforms of the scanning signal $V_{Scan}$ (represented by dotted lines) near the scanning signal input terminal and the data signal $V_{Data}$ (represented by dotted lines) near the data signal input terminal have slight delay, and waveforms of the scanning signal $V_{Scan}$ (represented by solid lines) away from the scanning signal input terminal and the data signal $V_{Data}$ (represented by solid lines) away from the data signal input terminal have serious delay, which induces great differences between cumulative luminance of the light-emitting diodes LEDs in the driving circuits of the scanning signals $V_{Scan}$ near the scanning signal input terminals and the data signals $V_{Data}$ near the data signal input terminals and cumulative luminance of the light-emitting diodes LEDs in the driving circuits of the scanning signals $V_{Scan}$ away from the scanning signal input terminals and the data signals $V_{Data}$ away from the data signal input terminals, resulting in luminance difference between a near-end and a far-end of the backlight module. Wherein, $V_{LED}$ is voltage between two ends of the light-emitting diode LED. The solid lines of the $V_{LED}$ represent voltage between the two ends of the light-emitting diodes LEDs away from the scanning signal input terminals and the data signal input terminals. The dotted lines of the $V_{LED}$ represent voltages between the two ends of the light-emitting diodes LEDs near the scanning signal input terminals and the data signal input terminals. $I_{LED}$ is a current flowing through the light-emitting diodes LEDs. The solid lines of the $I_{LED}$ represent the current flowing through the light-emitting diodes LEDs away from the scanning signal input terminals and the data signal input terminals, and the dotted lines of the $I_{LED}$ represent the current flowing through the light-emitting diodes LEDs near the scanning signal input terminals and the data signal input terminals.

Figure 3:
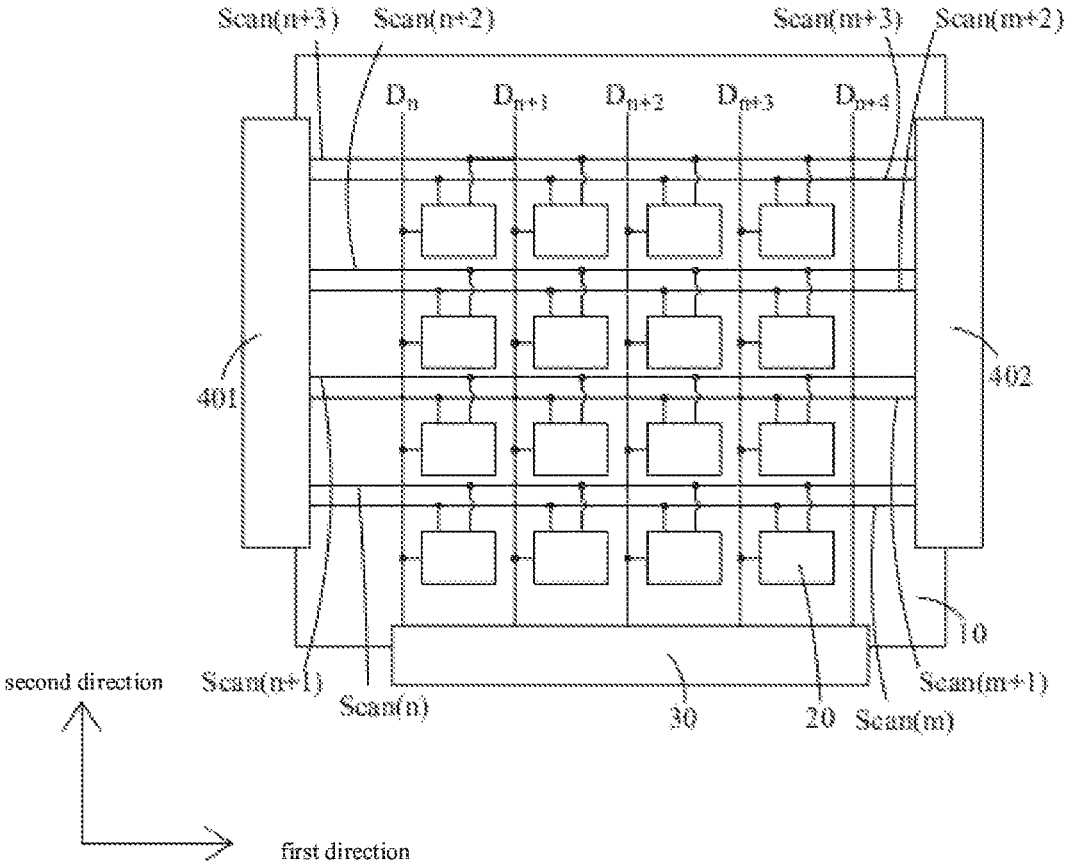
FIG. 3 is a schematic plan view of a backlight module in embodiments of the present application.
Figure 4:
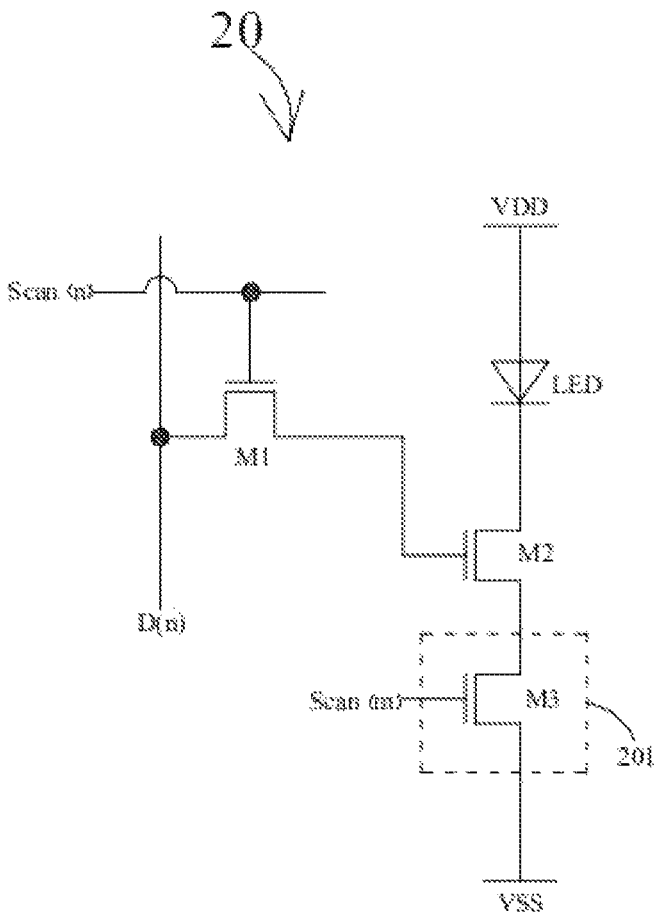
FIG. 4 is a schematic diagram of the driving circuit of the backlight module in FIG. 3.
Figure 5:
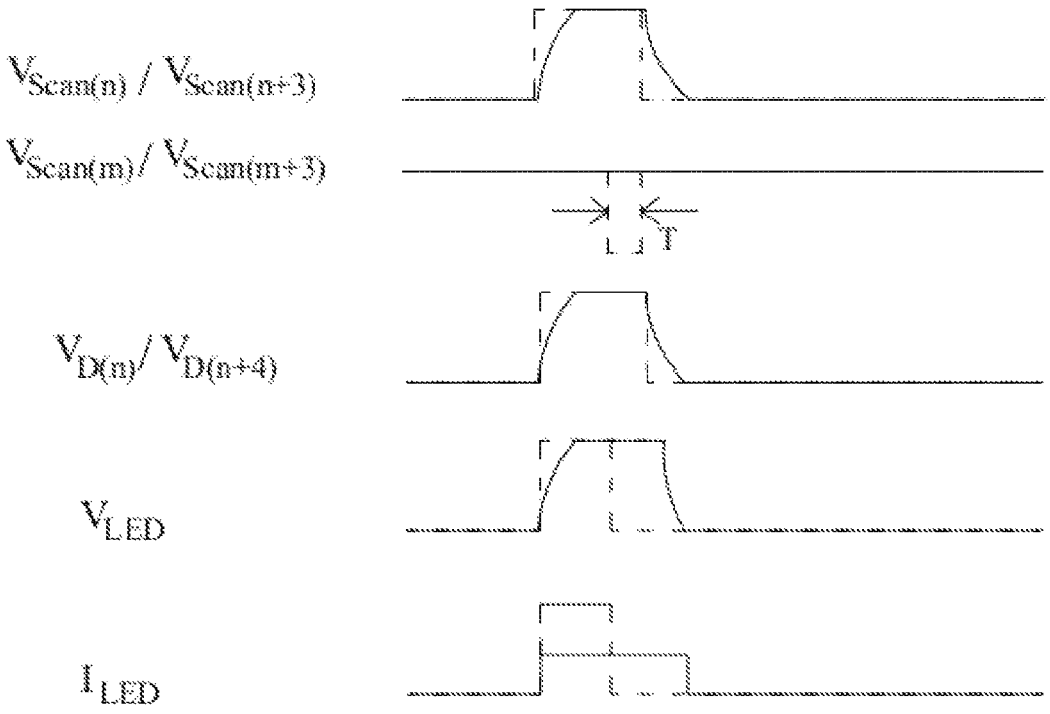
FIG. 5 is a sequence diagram of the near-ends of the scanning signal input terminal and the data signal input terminal, and the far-ends of the scanning signal input terminal and the data signal input terminal corresponding to the driving circuit illustrated in FIG. 4.

Please refer to FIG. 3 to FIG. 5, FIG. 3 is a schematic plan view of a backlight module in the embodiments of the present application; FIG. 4 is a schematic diagram of the driving circuit of the backlight module in FIG. 3; FIG. 5 is a sequence diagram of the driving circuit illustrated in FIG. 4. The backlight module includes a substrate 10, a data driving circuit 30, a gate electrode driving circuit, a plurality of driving circuits 20, a plurality of data lines, a plurality of first control signal lines, a plurality of second control signal lines, a plurality of first power supply signal lines VDD, and a plurality of second power supply signal lines VSS.

The plurality of data lines include a data line $D_n$, a data line $D_{n+1}$, a data line $D_{+2}$, a data line $D_{n+3}$, and a data line $D_{n+4}$ arranged in sequence. All of the data line $D_n$, the data line $D_{+1}$, the data line $D_{n+2}$, the data line $D_{n+3}$ and the data line $D_{n+4}$ extend along a second direction and are arranged side by side in a first direction. The first direction is perpendicular to the second direction. Each of the data lines includes a data signal input terminal. The data signal input terminal is close to the data driving circuit 30. The data signal input terminals of the plurality of data lines are connected to the data driving circuit 30. The data driving circuit 30 transmits data signals to the plurality of data lines. The data driving circuit is a source electrode driving circuit. The source electrode driving circuit is bonded to the substrate 10.

The plurality of first control signal lines include a first control signal line Scan(n), a first control signal line Scan (n+1), a first control signal line Scan(n+2), and a first control signal line Scan(n+3) arranged in sequence. All of the first control signal line Scan(n), the first control signal line Scan(n+1), the first control signal line Scan(n+2), and the first control signal line Scan(n+3) extend along the first direction, and are arranged side by side along the second direction. Each of the first control signal lines includes a first control signal input terminal, and the first control signal input terminal is disposed close to the first gate electrode driving circuit 401. The plurality of first control signal lines are configured to transmit first control signals.

The plurality of second control signal lines include a second control signal line Scan(m), a second control signal line Scan(m+1), a second control signal line Scan(m+2), and a second control signal line Scan(m+3) arranged in sequence. All of the second control signal line Scan(m), the second control signal line Scan(m+1), the second control signal line Scan(m+2), and the second control signal line Scan(m+3) extend along the first direction, and are arranged side by side along the second direction. Each of the second control signal lines is disposed next to one of the first control signal lines. The plurality of second control signal lines are configured to transmit second control signals.

The gate electrode driving circuit includes the first gate electrode driving circuit 401 and a second gate electrode driving circuit 402. The first control signal input terminals of the plurality of first control signal lines are connected to the first gate electrode driving circuit 401, so that the first control signals output by the first gate electrode driving circuit 401 can be output to the plurality of first control signal lines. The second control signal lines are connected to the second gate electrode driving circuit 402, so that the second control signals output by the second gate electrode driving circuit 402 can be output to the plurality of second control signal lines. The first gate electrode driving circuit 401 and the second gate electrode driving circuit 402 can be integrated in a same gate electrode driving chip. The gate electrode driving chip is bonded to the substrate 10.

The first gate electrode driving circuit 401 and the second gate electrode driving circuit 402 also can be disposed on the substrate 10, and the first gate electrode driving circuit 401 and the second gate electrode driving circuit 402 can be oppositely disposed on two sides of the substrate 10. It can be understood that the first gate electrode driving circuit 401 and the second gate electrode driving circuit 402 also can be disposed on a same side of the substrate 10.

The plurality of driving circuits 20 are arranged in a matrix on the substrate 10. The substrate 10 can be a glass substrate. Each of the driving circuits 20 is connected to one of the plurality of data lines, one of the plurality of first control signal lines, one of the plurality of second control signal lines, one of the plurality of first power supply signal lines VDD, and one of the plurality of second power supply signal lines VSS. The driving circuit 20 connected to the data line D(n), the first control signal line Scan(n), and the second control signal line Scan(m) is taken as example to illustrate the technical solution of the present application.

Each of the driving circuits 20 includes a light-emitting element LED, a switching transistor M1, a driving transistor M2, and a control unit 201.

The light-emitting element LED is connected between the first power supply signal line VDD and the second power supply signal line VSS. The first power supply signal line VDD is input with direct-current high-level voltage, and the second power supply signal line VSS is input with direct-current low-level voltage. The light-emitting element LED emits light when current passes. Cumulative luminance of the light-emitting element LED varies with durations of current passing through the light-emitting element LED.

Specifically, an anode of the light-emitting element LED is connected to the first power supply signal line VDD, and a cathode of the light-emitting element LED is connected to a first electrode of the driving transistor M2. The light-emitting element LED is a submillimeter light-emitting diode.

A gate electrode of the switching transistor M1 is connected to the first control signal line Scan(n), a first electrode of the switching transistor M1 is connected to a data line D(n), and a second electrode of the switching transistor M1 is connected to a gate electrode of the driving transistor M2. When the first control signal is valid, the switching transistor M1 is turned on, and the data signals are transmitted to the gate electrode of the driving transistor M2. When the first control signal is invalid, the switching transistor M1 is turned off.

Specifically, the switching transistor M1 is an N-type transistor, and the switching transistor M1 is a thin film transistor. In other embodiments, the switching transistor M1 can be a P-type transistor, and the switching transistor M1 can be a field effect transistor.

The gate electrode of the driving transistor M2 is connected to the second electrode of the switching transistor M1, one of the first electrode and the second electrode of the driving transistor M2 is connected to the light-emitting element LED, and one of the first electrode and the second electrode of the driving transistor M2 is connected to the second power supply signal line VSS. Driving current is outputted when the driving transistor M2 is turned on to drive the light-emitting element LED to emit light.

Specifically, the driving transistor M2 is an N-type transistor and also a thin film transistor. The gate electrode of the driving transistor M2 is connected to the second electrode of the switching transistor M1, the first electrode of the driving transistor M2 is connected to the cathode of the light-emitting element LED, and the second electrode of the driving transistor M2 is connected to the control unit 201. The driving transistor M2 also can be a P-type transistor.

The control unit 201 is connected to one of the first electrode or the second electrode of the driving transistor M2. When the switching transistor M1 is in an on state, the control unit 201 is in an off state during a pre-set period, and the control unit 201 is in an on state during periods other than the pre-set period.

Specifically, the control unit 201 includes a control transistor M3. A gate electrode of the control transistor M3 is connected to the second control signal line Scan(m). A first electrode of the control transistor M3 is connected to the second electrode of the driving transistor M2. A second electrode of the control transistor M2 is connected to the second power supply signal line VSS. When the second control signal is valid, the control unit 201 is in an on state, and when the second control signal is invalid, the control unit 201 is in an off state. The control transistor M3 is an N-type transistor. The control transistor M3 also can be a P-type transistor.

The second control signal is invalid during the pre-set period within a valid period of the first control signal and is valid during periods other than the pre-set period within the valid period of the first control signal to keep the control unit 201 in an off state during the pre-set period when the switching transistor M1 is in an on state, and to keep the control unit 201 in an on state during periods other than the pre-set period when the switching transistor M1 is in an on state. Correspondingly, time of the driving transistor M2 driving the light-emitting element LED to emit light is an overlapping period with the valid period of the second control signal of the valid period of the first control signal. Cumulative luminance of the light-emitting element can be adjusted by controlling the duration of the pre-set period. The shorter the pre-set period is, the longer the light-emitting time of the light-emitting element LED is. The longer the pre-set period is, the shorter the light-emitting time of the light-emitting element LED is. The duration of the pre-set period is shorter than a duration in which the switching transistor M1 is in an on state and is longer than or equal to 0. For example, the pre-set period is ¼, ⅛, 1/12, 1/16, etc., of duration of the valid period of the first control signal.

Durations of the pre-set periods of the plurality of driving circuits 20 decrease along a direction from close to the data signal input terminals to away from the data signal input terminals, and/or durations of the pre-set periods of the plurality of driving circuits 20 decrease along a direction from close to the first control signal input terminals to away from the first control signal input terminals.

Specifically, durations of the pre-set periods T of the plurality of driving circuits 20 decrease along a direction from close to the data signal input terminals to away from the data signal input terminals, and/or durations of the pre-set periods T of the plurality of driving circuits 20 decrease along a direction from close to the first control signal input terminals to away from the first control signal input terminals to make the pre-set periods of the driving circuits 20 near both of the first control signal input terminals and the data signal input terminals longer, and the pre-set periods of the driving circuits 20 away from both of the first control signal input terminals and the data signal input terminals shorter, so as to make luminance of the light-emitting elements LED in the driving circuits 20 of the near-end and the far-end identical.

As shown in FIG. 5, the first control signal $V_{Scan(n)}$, the second control signal $V_{Scan(m)}$, and the data signal $V_{D\ (n)}$ represented by the dotted lines are input to the driving circuits 20*a* near both of the first control signal input terminal and the data signal input terminal, and the voltage $V_{LED}$ and current $I_{LED}$ represented by the dotted lines are voltage and current of the light-emitting elements LEDs in the driving circuits 20*a* during light-emitting. The first control signal $V_{Scan(n+3)}$, the second control signal $V_{Scan(m+3)}$ and the data signal $V_{D\ (n=4)}$ represented by the solid lines are input to the driving circuits 20*b* far form both of the first control signal input terminal and the data signal input terminal, and the voltage $V_{LED}$ and current $I_{LED}$ represented by the solid lines are voltage and current of the light-emitting elements LEDs in the driving circuits 20*b* during light-emitting.

The duration of the pre-set periods T of the driving circuits 20*a* near both of the first control signal input terminal and the data signal input terminal is ⅜ of the valid period of the first control signal $V_{Scan(n)}$, i.e., a duration of an invalid period T of the second control signal $V_{Scan(m)}$ corresponds to ⅜ of the valid period of the first control signal $V_{Scan(n)}$, and the second control signal $V_{scan(m)}$ is valid in periods other than the pre-set period T of the valid period of the first control signal $V_{Scan(n)}$. A duration of an overlapping period of the valid period of the first control signal $V_{Scan(n)}$ and the valid period of the second control signal $V_{Scan(m)}$ is equal to ⅝ of the duration of the valid period of the first control signal $V_{Scan(n)}$. Light emitting time of the light-emitting elements LED in the driving circuits 20*b* is shorter, and the corresponding current $I_{LED}$ of the light-emitting elements LEDs is greater. A duration of the pre-set period T of the driving circuits 20*b* away from both of the first control signal input terminal and the data signal input terminal is 0, an overlapping period of the first control signal $V_{Scan(n+3)}$ and the second control signal $V_{Scan(m+3)}$ is equal to the valid period of the first control signal $V_{Scan(n+3)}$. Light emitting time of the light-emitting elements LEDs in the driving circuits 20*b* is shorter, and the corresponding current $I_{LED}$ of the light-emitting elements LEDs is less. Cumulative luminance of the current $I_{LED}$ of the light-emitting elements LEDs in the driving circuits 20*a* close to both of the first control signal input terminals and the data signal input terminals during the overlapping period of the valid period of the first control signal $V_{Scan(n)}$ and the second control signal $V_{Scan(m)}$ equals to the cumulative luminance of the current $I_{LED}$ of the light-emitting elements LEDs in the driving circuits 20*b* away from both of the first control signal input terminals and the data signal input terminals during the valid period of the first control signal $V_{Scan(n)}$ to make the luminance of the light-emitting elements LEDs in the driving circuits of the near-ends and far-ends of the first control signal input terminals and the data signal input terminals identical.

It can be understood that, it can also be that along the second direction, from the near-ends to the far-ends of the data signal input terminals, durations of the pre-set periods T of the plurality of driving circuits 20 decrease. For example, the durations of the pre-set periods of the driving circuits 20 close to the data driving circuit 30 within the plurality of driving circuits 20 connected to a same data line is larger than the durations of the pre-set periods of the driving circuits 20 away from the data driving circuit 30 to alleviate luminance differences induced by waveform delays of data signals caused by impedance in the data lines. Alternatively, along the first direction, from the near-ends to the far-ends of the first control signal input terminals, the pre-set periods T of the plurality of driving circuits 20 decreases. For example, the durations of the pre-set periods of the driving circuits 20 close to the first gate electrode driving circuit 401 within the plurality of driving circuits 20 connected to a same first control signal line is longer than the durations of the pre-set periods of the driving circuits 20 away from the first gate electrode driving circuit 401 to alleviate luminance differences induced by waveform delays of the data signals caused by the impedance of the first control signal lines.

The control unit 201 is in an on state when the switching transistor M1 is in an off state to keep the control unit 201 in an on state during periods other than the pre-set period T.

A falling edge of the valid first control signal is located in the pre-set period T to make the light-emitting diode LED stop emitting light under the action of the second control signal after light emitting from the light-emitting diode LED becomes stable, so as to avoid difficulty in adjusting light-emitting luminance caused by a pause of light emitting when light emitting of the light-emitting diode LED becomes unstable. Wherein, the falling edge is a time at which the valid period of the first control signal descends.

A display device is also provided by the present application. The display device includes a backlight module and a liquid crystal display panel. The liquid crystal display panel is located on a light-emitting side of the backlight module.

In the display device according to the present application, the luminance of the light-emitting elements LED in each of the driving circuits can be adjusted by the duration of the pre-set period in the backlight module. The durations of the pre-set periods of the plurality of driving circuits decrease along a direction from close to the data signal input terminals to away from the data signal input terminals, and/or durations of the pre-set periods of the plurality of driving circuits decrease along a direction from close to the first control signal input terminals to away from the first control signal input terminals. So that the light-emitting durations of the light-emitting elements near to the data signal input terminals are shorter than the light-emitting durations of the light-emitting elements away from the data signal input terminals, and/or light-emitting durations of the light-emitting elements close to the first control signal input terminals are shorter than the light-emitting durations of the light-emitting elements away from the first control signal input terminals, which benefits to the identity of the light-emitting luminance of the light-emitting elements of the near-end and the far-end to solve the display problems of the display device.

It can be understood that the display panel can also include a plurality of the above-mentioned driving circuits 20. Correspondingly, the light-emitting element LED can be miniature light-emitting diodes (Micro-LED) or organic light-emitting diodes. Luminance of the light-emitting elements LEDs at the near-end and the far-end are identical according to the distances from the driving circuits 20 to the first control signal input terminals and the data signal input terminals. Display effect of the display panel can be improved.

The description of the above embodiments is only intended to help understand the technical solutions and core concepts of this disclosure. It is noted that those with ordinary skill in the technique field could make various modifications to technical solutions or or equivalent replacements to part of the technical features described in embodiments above-mentioned, and these modifications and replacement don't make the substantial of corresponding technical solutions out of the scope of technical solutions of embodiments of the present application.

What is claimed is:

1. A light-emitting substrate, comprising:

a plurality of data lines, wherein each of the data lines comprises a data signal input terminal;

a plurality of first control signal lines, wherein each of the first control signal lines comprises a first control signal input terminal; and a plurality of driving circuits, wherein each of the driving circuits comprises:

a light-emitting element;

a switching transistor, wherein a gate electrode of the switching transistor is connected to the first control signal line, and a first electrode of the switching transistor is connected to the data line;

a driving transistor, wherein a gate electrode of the driving transistor is connected to a second electrode of the switching transistor, and one of a first electrode or a second electrode of the driving transistor is connected to the light-emitting element; and a control unit, wherein the control unit is in series connection with connected to one of the first electrode or the second electrode of the driving transistor, wherein when the switching transistor is in an on state, the control unit is in an off state during a pre-set period, the switching transistor is in an on state during periods other than the pre-set period, and the driving transistor driving the light-emitting element to emit light during the periods other than the pre-set period when the switching transistor is in an on state, wherein durations of the pre-set periods of the plurality of driving circuits decrease along a direction from close to the data signal input terminals to away from the data signal input terminals, or durations of the pre-set periods of the plurality of driving circuits decrease along a direction from close to the first control signal input terminals to away from the first control signal input terminals.

2. The light-emitting substrate according to claim 1, wherein the light-emitting substrate further comprises a plurality of second control signal lines, and the control unit comprises a control transistor, a gate electrode of the control transistor is connected to the second control signal line, and the control transistor is connected to the second electrode of the driving transistor.

3. The light-emitting substrate according to claim 1, wherein each of the first control signal lines is configured to transmit a first control signal, the switching transistor is in an on state according to a valid first control signal, and a falling edge of the valid first control signal is located in the pre-set period.

4. The light-emitting substrate according to claim 1, wherein the light-emitting element is connected to the first electrode of the driving transistor.

5. The light-emitting substrate according to claim 1, wherein the control unit is in an on state when the switching transistor is in an off state.

6. The light-emitting substrate according to claim 1, wherein the light-emitting substrate is a display panel or a backlight module.

7. The light-emitting substrate according to claim 1, wherein durations of the pre-set periods of the plurality of driving circuits decrease along a direction from close to the data signal input terminals to away from the data signal input terminals, and durations of the pre-set periods of the plurality of driving circuits decrease along a direction from close to the first control signal input terminals to away from the first control signal input terminals.

8. The light-emitting substrate according to claim 7, wherein the duration of the pre-set periods of the driving circuits near both of the first control signal input terminal and the data signal input terminal is ⅜ of a valid period of the first control signal in which the switching transistor is in an on state, a duration of an overlapping period of the valid period of the first control signal and an valid period of the second control signal in which the control unit is in an on state is equal to ⅝ of the duration of the valid period of the first control signal.

9. The light-emitting substrate according to claim 1, wherein the light-emitting element is at least one of sub-millimeter light-emitting diode, miniature light-emitting diode, or organic light-emitting diode.

10. The light-emitting substrate according to claim 1, wherein the light-emitting substrate further comprises a data driving circuit and a gate electrode driving circuit, the data signal input terminals of the plurality of data lines are connected to the data driving circuit, and the first control signal input terminals of the plurality of first control signal lines are connected to the gate electrode driving circuit.

11. The light-emitting substrate according to claim 1, wherein the pre-set period is ¼, ⅛, 1/12, or 1/16 of duration of a valid period of the first control signal in which the switching transistor is in an on state.

12. A display device comprising a light-emitting substrate, wherein the light-emitting substrate comprises:

a plurality of data lines, wherein each of the data lines comprises a data signal input terminal;

a plurality of first control signal lines, wherein each of the first control signal lines comprises a first control signal input terminal; and a plurality of driving circuits, wherein each of the driving circuits comprises:

a light-emitting element;

a switching transistor, wherein a gate electrode of the switching transistor is connected to the first control signal line, and a first electrode of the switching transistor is connected to the data line;

a driving transistor, wherein a gate electrode of the driving transistor is connected to a second electrode of the switching transistor, and one of a first electrode or a second electrode of the driving transistor is connected to the light-emitting element; and a control unit, wherein the control unit is in series connection with connected to one of the first electrode or the second electrode of the driving transistor, wherein when the switching transistor is in an on state, the control unit is in an off state during a pre-set period, the switching transistor is in an on state during periods other than the pre-set period, and the driving transistor driving the light-emitting element to emit light during the periods other than the pre-set period when the switching transistor is in an on state;

wherein durations of the pre-set periods of the plurality of driving circuits decrease along a direction from close to the data signal input terminals to away from the data signal input terminals, or durations of the pre-set periods of the plurality of driving circuits decrease along a direction from close to the first control signal input terminals to away from the first control signal input terminals.

13. The display device according to claim 12, wherein the light-emitting substrate further comprises a plurality of second control signal lines; and the control unit comprises a control transistor, a gate electrode of the control transistor is connected to the second control signal line, and the control transistor is connected to the second electrode of the driving transistor.

14. The display device according to claim 12, wherein each of the first control signal lines is configured to transmit a first control signal, the switching transistor is in an on state according to a valid first control signal, and a falling edge of the valid first control signal is located in the pre-set period.

15. The display device according to claim 12, wherein the light-emitting element is connected to the first electrode of the driving transistor.

16. The display device according to claim 12, wherein the control unit is in an on state when the switching transistor is in an off state.

17. The display device according to claim 12, wherein the light-emitting substrate is a display panel or a backlight module.

18. The display device according to claim 12, wherein durations of the pre-set periods of the plurality of driving circuits decrease along a direction from close to the data signal input terminals to away from the data signal input terminals, and durations of the pre-set periods of the plurality of driving circuits decrease along a direction from close to the first control signal input terminals to away from the first control signal input terminals.

19. The display device according to claim 12, wherein the light-emitting element is at least one of submillimeter light-emitting diode, miniature light-emitting diode, or organic light-emitting diode.

20. The display device according to claim 12, wherein the light-emitting substrate further comprises a data driving circuit and a gate electrode driving circuit, the data signal input terminals of the plurality of data lines are connected to the data driving circuit, and the first control signal input terminals of the plurality of first control signal lines are connected to the gate electrode driving circuit.

* * * * *